US010294829B2

(12) United States Patent
Manako et al.

(10) Patent No.: US 10,294,829 B2
(45) Date of Patent: May 21, 2019

(54) VALVE TIMING CONTROL DEVICE FOR INTERNAL COMBUSTION ENGINE

(71) Applicant: HITACHI AUTOMOTIVE SYSTEMS, LTD., Hitachinaka-shi, Ibaraki (JP)

(72) Inventors: Masato Manako, Atsugi (JP); Mikihiro Kajiura, Tama (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 15/578,355

(22) PCT Filed: May 6, 2016

(86) PCT No.: PCT/JP2016/063643
§ 371 (c)(1),
(2) Date: Nov. 30, 2017

(87) PCT Pub. No.: WO2016/194544
PCT Pub. Date: Dec. 8, 2016

(65) Prior Publication Data

US 2018/0135469 A1 May 17, 2018

(30) Foreign Application Priority Data

Jun. 2, 2015 (JP) ..... 2015-111840

(51) Int. Cl.
*F01L 1/344* (2006.01)
*F01L 1/352* (2006.01)
(Continued)

(52) U.S. Cl.
CPC ..... *F01L 1/344* (2013.01); *F01L 1/352* (2013.01); *F01L 1/047* (2013.01); *F01L 1/46* (2013.01);
(Continued)

(58) Field of Classification Search
CPC ..... F01L 1/344; F01L 1/46; F01L 2013/103; F01L 2820/032
(Continued)

(56) References Cited

U.S. PATENT DOCUMENTS

2012/0291750 A1 11/2012 Yokoyama et al.
2012/0312258 A1* 12/2012 Kimus ..... F01L 1/352 123/90.15
(Continued)

FOREIGN PATENT DOCUMENTS

JP S56-151542 U 11/1981
JP H03-065024 U 6/1991
(Continued)

*Primary Examiner* — Jorge Leon, Jr.
(74) *Attorney, Agent, or Firm* — Foley & Lardner LLP

(57) ABSTRACT

A valve timing control device for an internal combustion engine; a driving rotation member to which a rotational force is transmitted from a crank shaft; a driven rotation member arranged to rotate as a unit with a cam shaft; and a fixing member disposed between an axial one end portion of the cam shaft and the driven rotation member, the driven rotation member including a first recessed portion formed at a position to confront the axial one end portion of the cam shaft, and the fixing member including a second recessed portion which is formed at a position to confront the axial one end portion of the cam shaft, and in which the one end portion of the cam shaft is mounted from an axial direction, and a raised portion mounted in the first recessed portion.

13 Claims, 9 Drawing Sheets

(51) Int. Cl.
*F01L 13/00* (2006.01)
*F01L 1/46* (2006.01)
*F01L 1/047* (2006.01)

(52) U.S. Cl.
CPC ..... *F01L 2013/103* (2013.01); *F01L 2101/00* (2013.01); *F01L 2103/00* (2013.01); *F01L 2250/02* (2013.01); *F01L 2820/032* (2013.01); *F01L 2820/04* (2013.01); *F01L 2820/042* (2013.01); *F01L 2820/044* (2013.01)

(58) Field of Classification Search
USPC ..... 123/90.17
See application file for complete search history.

(56) References Cited

U.S. PATENT DOCUMENTS

| | | | | |
|---|---|---|---|---|
| 2013/0319357 | A1 | 12/2013 | Suzuki et al. | |
| 2014/0245978 | A1* | 9/2014 | Tadokoro ..... | F01L 1/344 123/90.11 |

FOREIGN PATENT DOCUMENTS

| | | | |
|---|---|---|---|
| JP | 2013-227919 | A | 11/2013 |
| JP | 2013-249750 | A | 12/2013 |
| WO | WO-2011/99124 | A1 | 8/2011 |

* cited by examiner

VALVE TIMING CONTROL DEVICE FOR INTERNAL COMBUSTION ENGINE

TECHNICAL FIELD

This invention relates to a valve timing control device for an internal combustion engine which is configured to control an opening timing and a closing timing of an intake valve and an exhaust valve.

BACKGROUND ART

There is known a valve timing control device for an internal combustion engine described in a below-described patent document 1 previously filed by the applicant.

This valve timing control device includes an is electric motor integrally provided to a timing sprocket.

This valve timing control device is arranged to transmit a rotational force of the electric motor to a driven member through a speed reduction mechanism provided within the timing sprocket, thereby to convert a relative rotation phase of a cam shaft with respect to a crank shaft, and to control opening and closing timings of an intake valve and an exhaust valve.

An annular stopper plate is fixed on a rear end surface of the timing sprocket on the cam shaft's side by bolts. A disc-shaped adapter is provided on an inner circumference side of the stopper plate. The adapter is arranged to restrict a maximum relative rotation position between the timing sprocket and the cam shaft in cooperation with the stopper plate.

This adapter is disposed between a fixing end portion of the driven member and the cam shaft. The adapter includes an outer end surface having an inner circumference portion on which an axial one end surface of the cam shaft is abutted. This adapter is fixed together by a cam bolt inserted from the driven member side.

PRIOR ART DOCUMENT

Patent Document

Patent Document 1: Japanese Patent Application Publication No. 2013-227919

SUMMARY OF THE INVENTION

Problems Which the Invention is Intended to Solve

However, in this valve timing control device, it is desired to make an axial length of the entire device as short as possible, for ensuring preferable mountability within an engine room.

However, in the conventional valve timing control device, the axial length reduction is not considered. In particular, the adapter is disposed between the axial one end portion of the cam shaft and the fixing end portion of the driven member, so that an axial length becomes long by a thickness of the adapter.

It is, therefore, an object of the present invention to provide a valve timing control device for an internal combustion engine which is devised to solve the above-mentioned problems, and to sufficiently shorten an axial length in a relative relationship between a cam shaft and the device.

Means for Solving the Problem

In this invention, specifically, the driven rotation member includes a first recessed portion formed at a position to confront an axial one end portion of the cam shaft. The fixing member includes a second recessed portion which is formed at a position to confront the one axial end portion of the cam shaft, and in which the one end portion of the cam shaft is mounted from the axial direction; and a raised portion mounted in the first recessed portion.

Benefit of the Invention

In this invention, it is possible to sufficiently shorten the axial length of the device by a relative relationship with the cam shaft.

BRIEF DESCRIPTION OF DRAWINGS

FIG. 6A is a front view of the adapter. FIG. 6B is a sectional view taken along a B-B line of FIG. 6A.

DESCRIPTION OF EMBODIMENTS

Hereinafter, a valve timing control device for an internal combustion engine according to embodiments of the present invention are explained with reference to the drawings. Besides, in this embodiment, the present invention is applied to the valve timing control apparatus on an intake valve side. However, the present invention is applicable to the valve timing control apparatus on an exhaust valve side.

Figure 1:
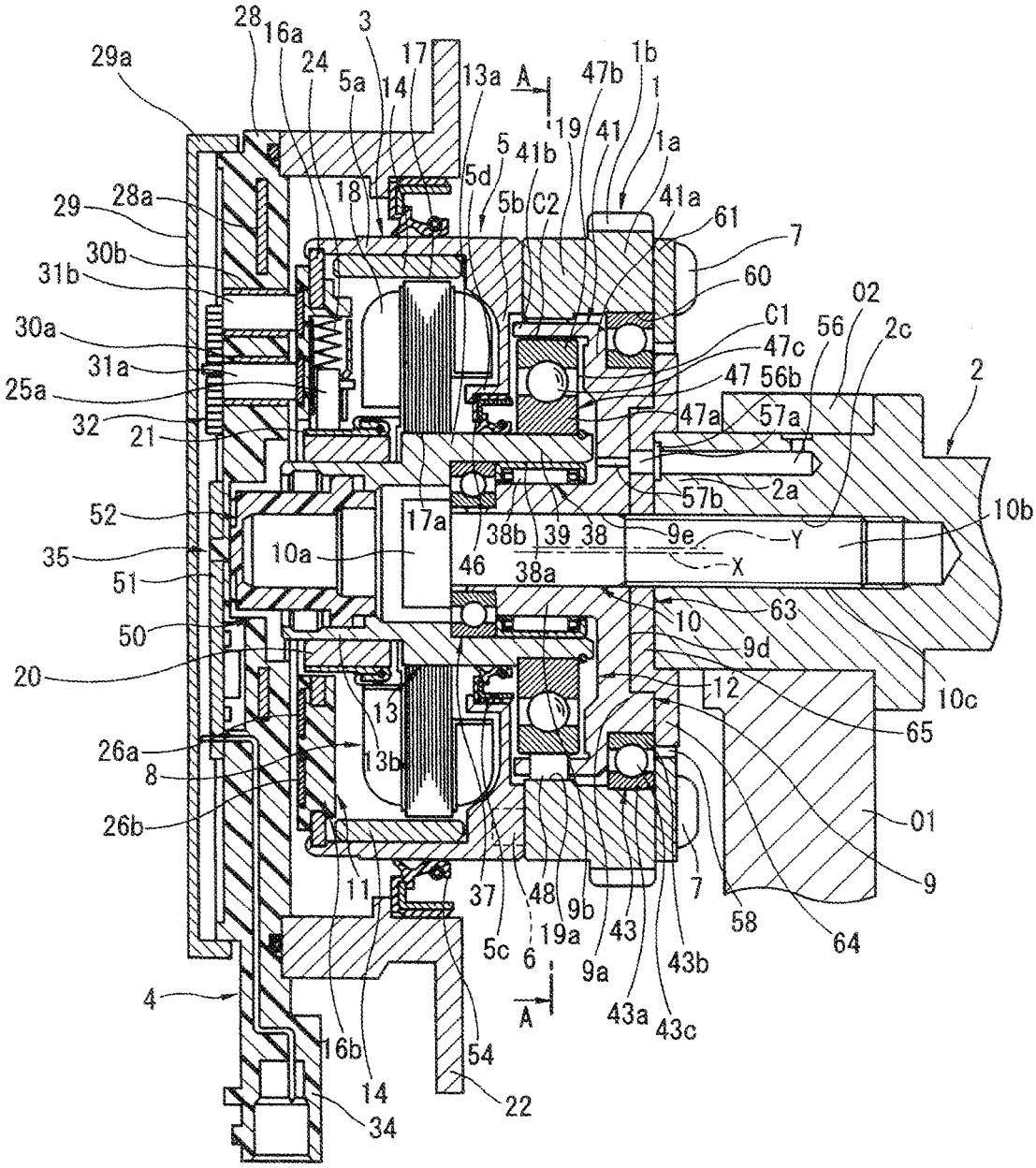
FIG. 1 is a longitudinal sectional view showing a valve timing control device according to a first embodiment of the present invention.
Figure 3:
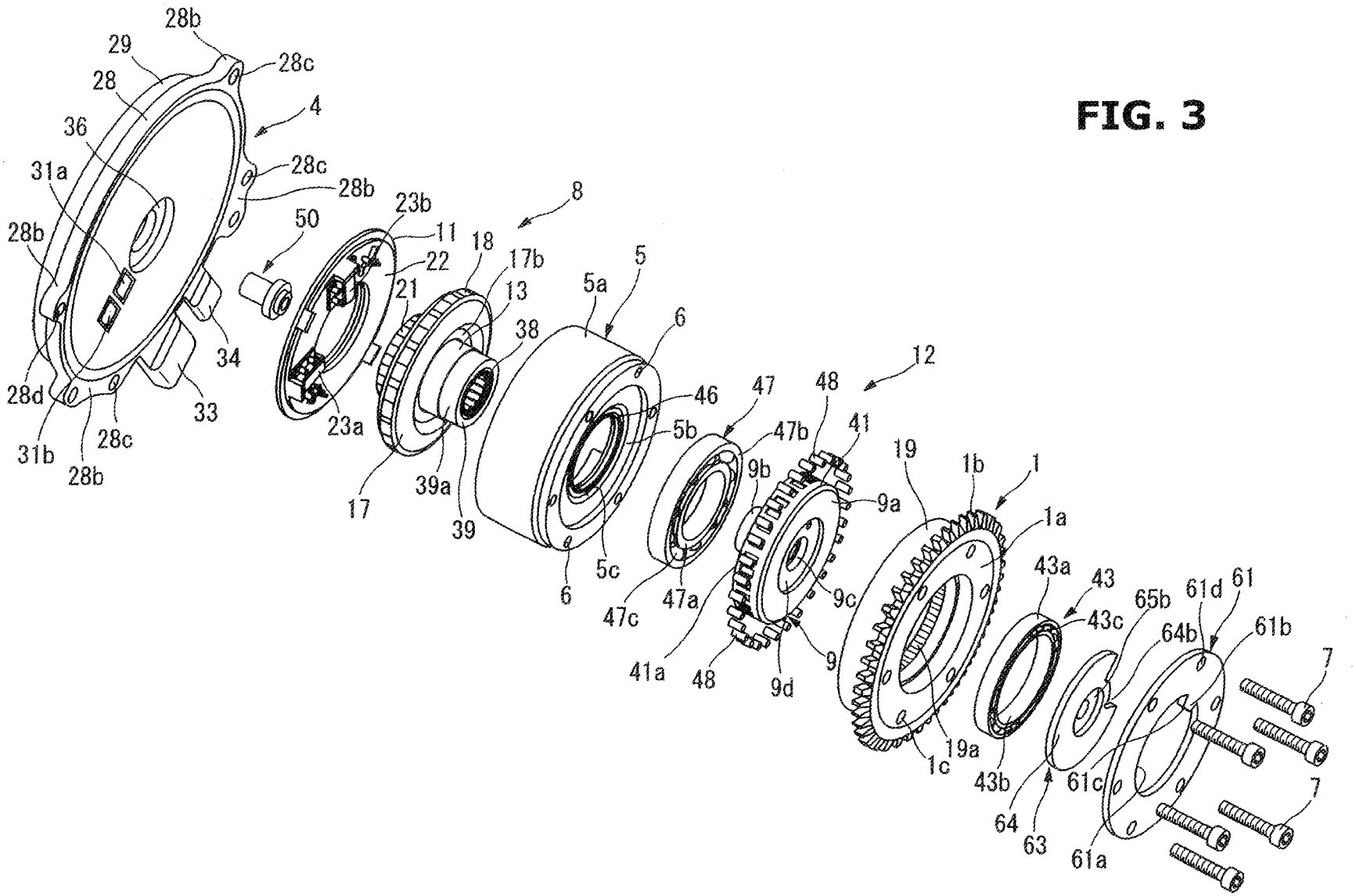
FIG. 3 is an exploded perspective view showing main constituting elements in this embodiment.
Figure 4:
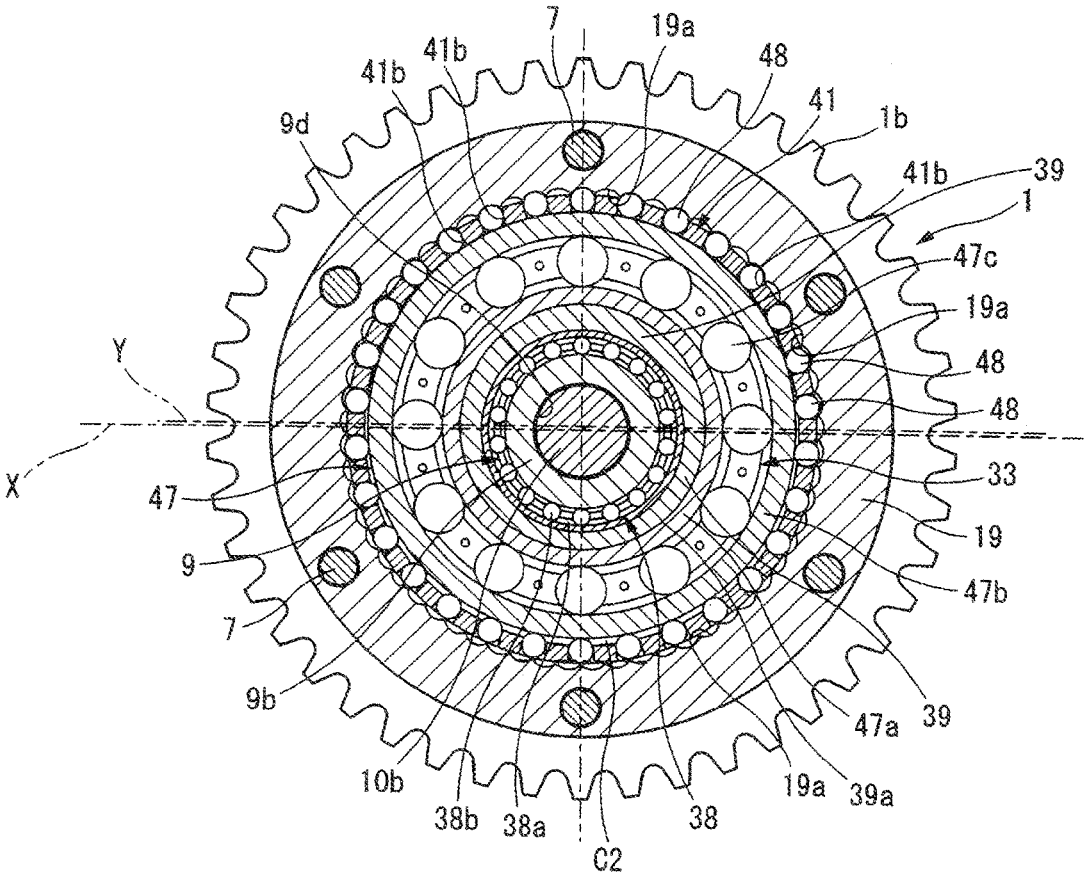
FIG. 4 is a sectional view taken along an A-A line of FIG. 1.

As shown in FIG. 1 and FIG. 3, the valve timing control device includes a timing sprocket 1 which is a driving rotation member that is drivingly rotated by a crank shaft of the internal combustion engine; a cam shaft 2 which is rotatably supported through a bearing 02 on a cylinder head 01, which is provided to be rotated relative to the timing sprocket 1, and which is arranged to be rotated by a rotational force (torque) transmitted from the timing sprocket 1; and a phase varying mechanism 3 which is disposed between the timing sprocket 1 and the cam shaft 2, and which is arranged to vary a relative rotational phase between the timing sprocket 1 and the cam shaft 2 in accordance with a driving state of the engine; and a cover member 4 disposed at a front end of the phase varying mechanism 3.

Figure 2:
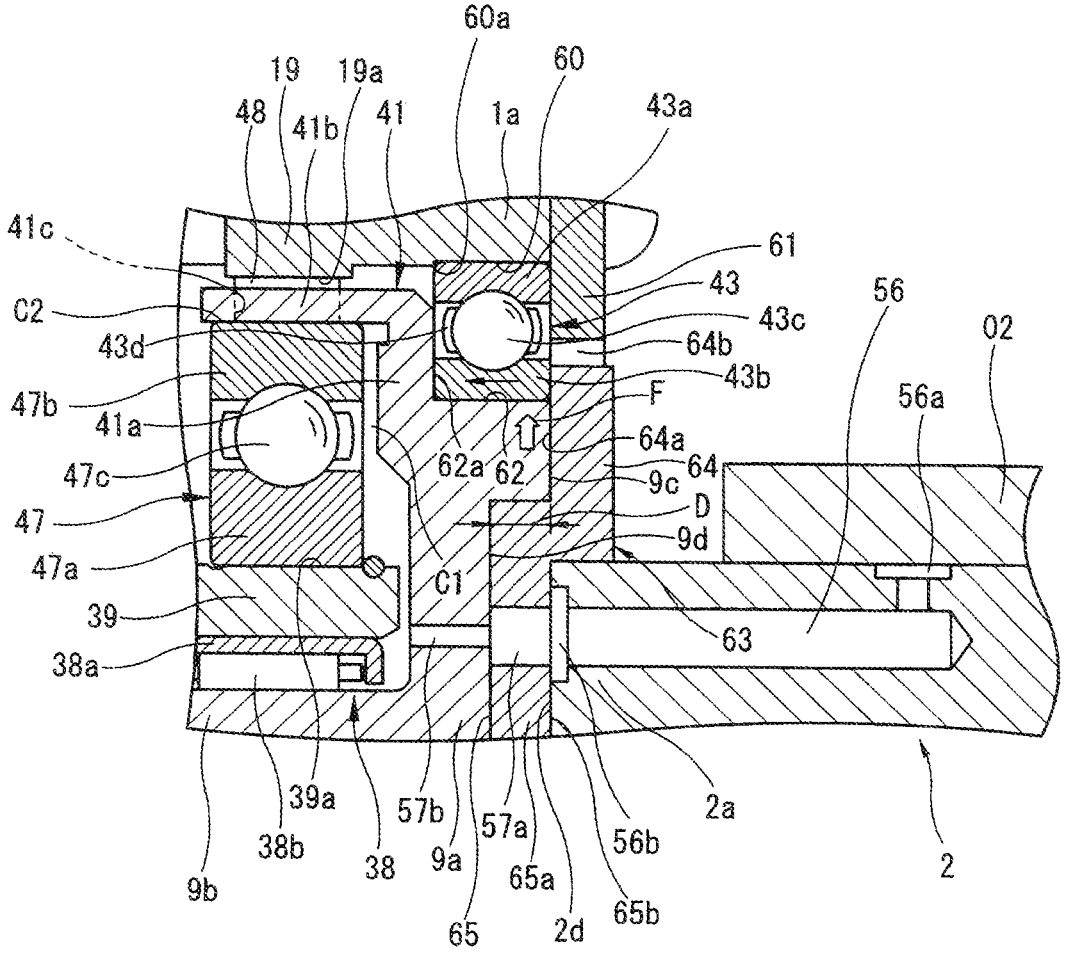
FIG. 2 is an enlarged view showing main portions of the valve timing control device shown in FIG. 1.

As shown in FIG. 2, an entire of the timing sprocket 1 is integrally made from iron series metal into an annular shape. The timing sprocket 1 includes a sprocket main body 1*a* having a relatively small outside diameter; a gear portion 1*b* which is integrally provided on an outer circumference of the sprocket main body 1*a*, and which is arranged to receive the rotational force from the crank shaft through a wound timing chain (not shown); and an internal teeth constituting section 19 which is integrally provided on the front end side of the sprocket main body 1*a*.

The sprocket main body 1*a* includes an inner is circumference surface formed into a stepped shape; and an outer wheel fixing surface 60 which is formed into an annular groove shape by cutting, and which is formed on the inner circumference surface to be opened to one end side that is the cam shaft 2's side in the axial direction. This outer wheel fixing surface 60 includes a stepped surface 60*a* which is formed on an inner end side in the axial direction, and which is formed along a direction perpendicular to the axial direction.

The internal teeth constituting section 19 is integrally provided on an outer circumference side of a front end portion of the sprocket main body 1*a*. The internal teeth constituting section 19 has a cylindrical shape extending in a forward direction toward the phase varying mechanism 3. The internal teeth constituting section 19 includes a plurality of internal teeth 19*a* which are formed on the inner circumference, and which have a corrugated (waveform) shape.

Moreover, this timing sprocket 1 is provided with a large diameter ball bearing 43 disposed between the sprocket main body 1*a* and a driven member 9 which is a driven rotation member described later, and which is provided at an axial one end portion of the cam shaft 2. The timing sprocket 1 is supported by this large diameter bearing 43 to be rotated relative to the driven member 9 (the cam shaft 2).

As shown in FIG. 2 and FIG. 3, the large diameter bearing 43 includes an outer wheel 43*a*; an inner wheel 43*b*; balls 43*c* disposed between the outer wheel 43*a* and the inner wheel 43*b*; and a cage 43*d* arranged to hold is the balls 43*c*.

The outer wheel 43*a* includes an outer circumference surface fixed on an inner circumference surface of the outer wheel fixing surface 60 of the sprocket main body 1*a* from the axial direction by the press-fit. The outer wheel 43*a* is abutted on the inside stepped surface 60*a* of the outer wheel fixing surface 60, and thereby positioned in the axial direction.

The inner wheel 43*b* is fixed on an outer circumference surface of the annular inner wheel fixing surface 62 which is formed on an outer circumference side of a fixing end portion 9*a* (described later) of the driven member 9, from the axial direction by the press fit. The inner wheel 43*b* is abutted on an inside stepped surface 62*a* of the inner wheel fixing surface 62, and thereby positioned in the axial direction.

Figure 5:
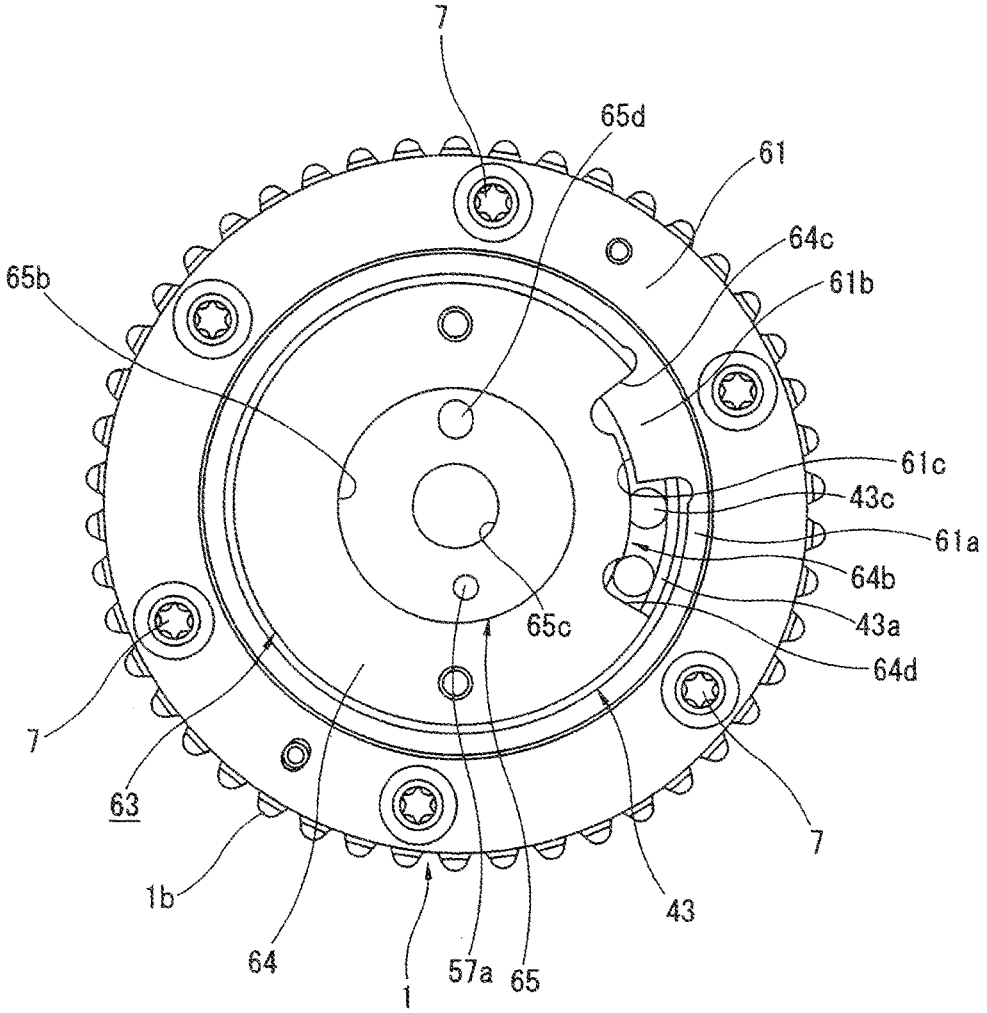
FIG. 5 is a right side view showing the valve timing control device which is detached from a cam shaft.
Figure 6:
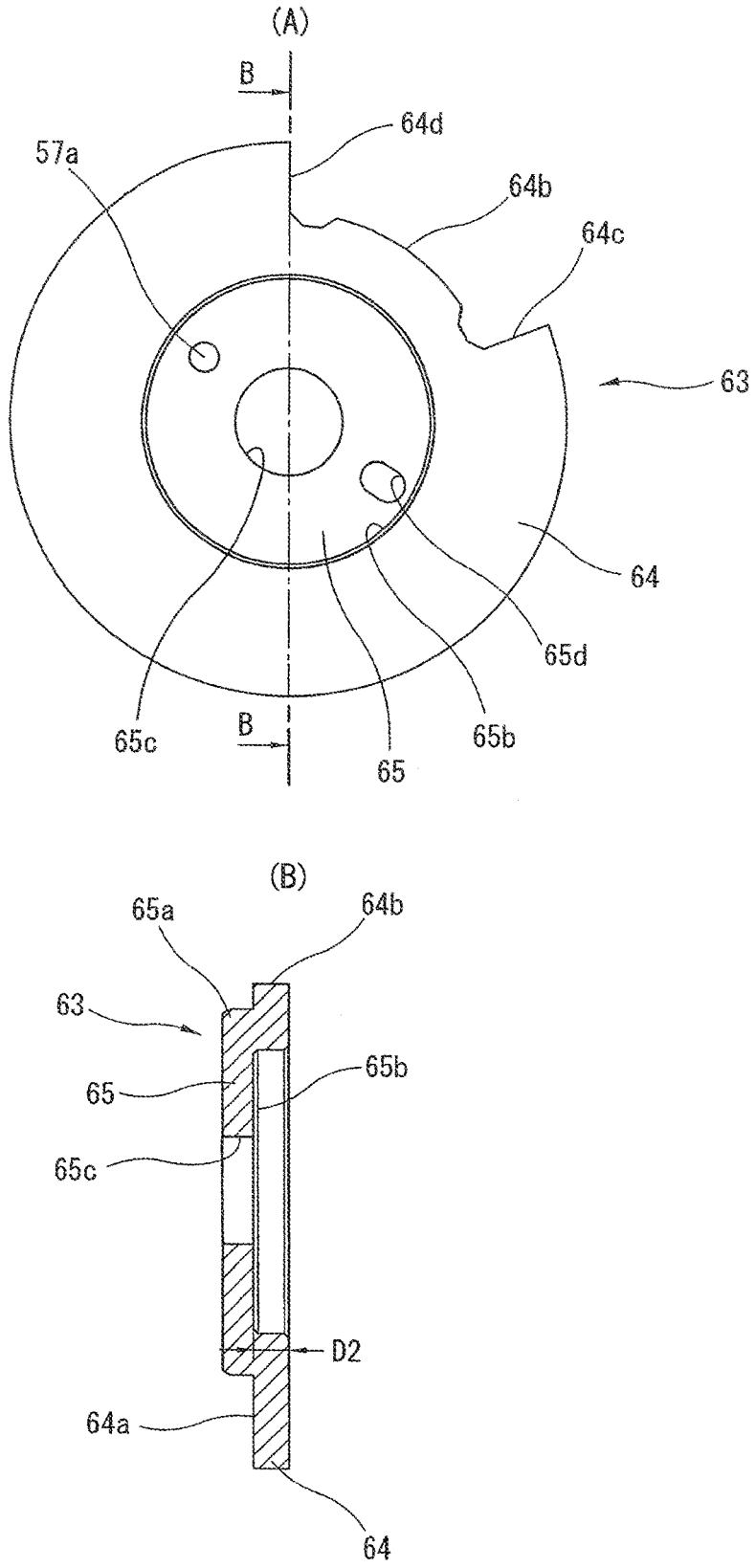
FIG. 6 show an adapter in this embodiment.

Moreover, a stopper plate 61 is fixed on a rear end surface of the sprocket main body 1*a* which is opposite to the internal teeth constituting section 19. As shown in FIG. 1 and FIG. 5, this stopper plate 61 is formed of a sheet metal into an annular shape. The stopper plate 61 has an outside diameter which is substantially identical to the outside diameter of the sprocket main body 1*a*, and an inside diameter which is smaller than an inside diameter of the outer wheel 43*a* of the large diameter ball bearing 43. The stopper plate 61 includes an inner circumference portion 61*a* which is disposed to be abutted on an axial outer end surface of the outer wheel 43*a*.

A protruding portion 61*b* is integrally provided at a predetermined position of an inner circumference edge of is the inner circumference portion 61*a* of the stopper plate 61. The protruding portion 61*b* protrudes in a radially inside direction of FIG. 5, that is, toward the center axis.

As shown in FIG. 5, this protruding portion 61*b* is formed into a substantially sectorial shape (fan shape). The protruding portion 61*b* includes a tip end edge 61*c* having an arc shape along an arc inner circumference surface of the stopper recessed groove 64*b* which is a groove portion of the adapter 63 (described later). Moreover, the stopper plate 61 includes six bolt insertion holes 61*d* which are formed in an outer circumference portion of the stopper plate 61 at a regular interval in the circumferential direction, which penetrate through the stopper plate 61, and through which bolts 7 are inserted.

The sprocket main body 1*a* (the internal teeth constituting section 19) includes six bolt insertion holes 1*c* which are formed in an outer circumference portion of the sprocket main body 1*a* at a substantially regular interval in the circumferential direction, and which penetrate through the sprocket main body 1*a*. The stopper plate 61 includes the six bolt insertion holes 61*d* which are formed in an outer circumference portion of the stopper plate 61 at a substantially regular interval in the circumferential direction, and which penetrate through the stopper plate 61.

A motor housing 5 of an electric motor 8 described later is connected through the bolts 7 to an outer end surface of the internal teeth constituting section 19 from the axial direction.

As shown in FIG. 1, this motor housing 5 includes a housing main body 5*a* which is formed into a is bottomed cylindrical shape by press-forming the iron series metal material; and a power feeding plate 11 which closes a front end opening of the housing main body 5*a*.

The housing main body 5*a* has a relatively small outside diameter, similarly to the outside diameter of the sprocket main body 1*a*. The housing main body 5*a* includes a separation wall 5*b* which has a circular plate shape, and which is disposed on a rear end side of the housing main body 5*a*. The separation wall 5*b* includes a shaft insertion hole 5*c* which has a large diameter, which is formed at a substantially central portion of the separation wall 5*b*, and through which a motor output shaft 13 (described later) and an eccentric shaft portion 39 (described later) are inserted; and an elongating portion 5*d* which has a cylindrical shape, which is integrally provided on an edge of the shaft insertion hole 5*c*, and which protrudes in a radially inside direction. Moreover, the separation wall 5*b* includes internal screw holes 6 which are formed in the axial direction in the inside of an outer circumference portion of the separation wall 5*b*.

The internal screw holes 6 are formed at positions corresponding to the positions of the bolt insertion holes 1*c* and 61*d*. The timing sprocket 1 (the internal teeth constituting section 19), the stopper plate 61, and the housing main body 5*a* are fixed by being tightened together by the six bolts 7 inserted through the bolt insertion holes 1*c* and 61*d*, and the internal screw holes 6 from the axial direction.

The cam shaft 2 includes two drive cams which are provided to each of the cylinders, which are provided on an outer circumference of the cam shaft 2, and each of which is arranged to open the intake valve (not shown). The driven member 9 which is the driven rotation member is fixed to an axial one end portion 2*a* of the cam shaft 2 through the adapter 63 which is the fixing member, by being tightened together by a cam bolt 10 from the axial direction.

The driven member 9 is integrally made from the iron series metal. As shown in FIG. 1 and FIG. 2, the driven member 9 includes the fixing end portion 9*a* which has a circular plate shape, and which is formed on a rear end side (the cam shaft 2's side); a cylindrical portion 9*b* which protrudes from the front end surface of the inner circumference of the fixing end portion 9*a* in the axial direction; and a holding (retaining) device 41 which is a holding member, which has a cylindrical shape, which is integrally formed on the outer circumference portion of the fixing end portion 9*a*, and which holds a plurality of rollers 48.

The fixing end portion 9*a* includes an outer side surface 9*c* disposed to confront a front end surface side of the one end portion 2*a* of the cam shaft 2; and a first mounting groove 9*d* which is a first recessed portion formed at a substantially central position of the outer side surface 9*c*. This first mounting groove 9*d* is formed into a disc shape. The first mounting groove 9*d* has an inside diameter greater than an outside diameter of the one end portion 2*a* of the cam shaft 2. The first mounting groove 9*d* has a depth D which is substantially identical to a thickness of the adapter 63. An inner circumference surface of the first mounting groove 9*d* is positioned to be overlapped with the inner wheel 43*b* of the large diameter ball bearing 43 in the radial direction.

As shown in FIG. 1, the cylindrical portion 9*b* includes an insertion hole 9*e* which is formed at a substantially central portion of the cylindrical portion 9*b*, which penetrates through the cylindrical portion 9*b*, and through which the shaft portion 10*b* of the cam bolt 10 is inserted. A needle bearing 38 and a small diameter ball bearing 37 are provided in a parallel state on the outer circumference side of the cylindrical portion 9*b*.

As shown in FIG. 1, the cam bolt 10 includes a head portion 10*a* having an axial end surface supporting an inner wheel of the small diameter ball bearing 37 in the axial direction; and an external screw 10*c* which is formed on an outer circumference of the shaft portion 10*b*, and which is screwed in an internal screw 2*c* formed within the inside from the end portion of the cam shaft 2 in the axial direction.

As shown in FIG. 1 to FIG. 3, and FIG. 6A and 6B, the adapter 63 is formed and bent to have a flange-shaped longitudinal section, by press-forming a disc-shaped sheet metal having a constant thickness. The adapter 63 includes an outer circumference portion 64 having a flange shape; an inner circumference portion 65 which is a central side, and which has a bottomed cylindrical shape protruding toward the electric motor 8.

The outer circumference portion 64 includes an outside diameter which is slightly greater than an outside diameter of the fixing end portion 9*a* (the inner wheel fixing surface 62) of the driven member 9. After the assembly of the constituting components, an outer circumference side of an inner end surface 64*a* of the outer circumference portion 64 on the electric motor 8's side is abutted on an axial outer end surface of the inner wheel 43*b* of the large diameter ball bearing 43 to restrict the axial movement. An inner circumference side of the inner end surface 64*a* confronts the outer side surface 9*c* of the fixing end portion 9*a* of the driven member 9 with a minute clearance in the axial direction.

As shown in FIG. 5, the outer circumference portion 64 includes the stopper recessed groove 64*b* which is a groove portion, which is formed on an outer circumference surface of the outer circumference portion 64 in the circumferential direction, and into which the protruding portion 61*b* of the stopper plate 61 is inserted and engaged. This stopper recessed groove 64*b* is formed into an arc shape having a predetermined length in the circumferential direction. Both end edges of the protruding portion 61*b* arranged to be pivoted within the predetermined length range are arranged to be abutted, respectively, on circumferential confronting edges 64*c* and 64*d*, and thereby to restrict relative rotation positions on a maximum advance angle side and a maximum retard angle side of the cam shaft 2 with respect to the timing sprocket 1.

A stopper mechanism is constituted by the protruding portion 61*b* of the stopper plate 61, and the confronting edges 64*c* and 64*d* of the stopper recessed groove 64 of the adapter.

The inner circumference portion 65 includes a raised portion 65*a* which has a bottomed cylindrical shape, and which protrudes toward the electric motor 8; and a second mounting groove 65*b* which is a second recessed portion, which has a disc groove shape, and which is simultaneously formed when the raised portion 65*a* is formed (molded) by the press-forming.

The inner circumference portion 65 includes an insertion hole 65*c* which is formed at a central position of the raised portion 65*a* (the second mounting groove 65*b*), which penetrates through the raised portion 65*a*, and through which the shaft portion 10*b* of the cam bolt 10 is inserted; and a positioning elongated hole 65*d* which is formed at a radial position around the insertion hole 65*c* that is a center, which penetrates through the raised portion 65*a*, and into which a positioning pin (not shown) protruding from the end surface of the one end portion 2*a* of the cam shaft 2 is inserted. Moreover, an oil passage hole 57*a* is formed at a position opposite to the positioning elongated hole 65*d* in the radial direction to sandwich the insertion hole 65*c* to penetrate through the raised portion 65*a*. The oil passage hole 57*a* constitutes a part of a lubricant passage (described later).

The raised portion 65*a* is mounted in the first mounting groove 9*d* of the fixing end portion 9*a* of the driven member 9 from the axial direction by the press fit. That is, the outer circumference surface of the raised portion 65*a* is mounted in the inner circumference surface of the first mounting groove 9*d* from the axial direction by the press fit. In this mounted state, a wall portion of the is raised portion 65*a* (a bottom wall of the second mounting groove 65*b*) is connected between the one end portion 2*a* of the cam shaft 2 and the fixing end portion 9*a* of the driven member 9 in the sandwiched state by the cam bolt 10.

The second mounting groove 65*b* has an inside diameter slightly greater than the outside diameter of the one end portion 2*a* of the cam shaft 2. The one end portion 1*a* is arranged to be mounted in the second mounting groove 65*b* from the axial direction. The second mounting groove 65*b* has a depth D2 which is set to a substantially 3 mm. Accordingly, a mounting amount of the one end portion 2*a* of the cam shaft 2 is a substantially 2 mm.

As shown in FIG. 1 and FIG. 2, the holding device 41 is formed by being bent from the front end of the outer circumference portion of the fixing end portion 9*a* in the forward direction to have a substantially L-shaped section. The holding device 41 includes a transmitting base portion 41*a* which has an annular shape, and which extends in the radial direction on the front end side of the outer circumference portion; and a roller holding portion 41*b* which has a cylindrical shape, and which extends from an outer end of the transmitting base portion 41*a* in a direction substantially perpendicular to the axial direction.

The transmitting base portion 41*a* includes a back surface which is the stepped surface 62*a* of the inner wheel fixing surface 62; and an outer circumference portion extending near an axial one end surface of the outer wheel 43*a* of the large diameter ball bearing 43.

The roller holding portion 41*b* includes a tip end portion which extends in a direction of the separation wall 5*b* through a receiving space which has an annular recessed shape, and which is separated by the internal teeth constituting section 19 and the separation wall 5*b*. The roller holding portion 41*b* includes a plurality of roller holding holes 41*c* each of which has a substantially rectangular shape, which are formed at a regular interval in the circumferential direction, and each of which is arranged to hold one of the plurality of the rollers 48 so that the each of the rollers 48 is rolled. Each of the roller holding holes 41*c* (the rollers 48) has a shape which is elongated in the forward and rearward directions, and which has a tip end portion side that is closed. A number of the roller holding holes 41*c* (the rollers 48) is smaller than a number of the teeth of the internal teeth 19*a* of the internal teeth constituting section 19. With this, it is possible to obtain a speed reduction ratio.

The phase varying mechanism 3 includes the electric motor 8 disposed on the front end side of the cylindrical portion 9*b* of the driven member 9; and a speed reduction mechanism 12 arranged to reduce a rotation speed of the electric motor 8, and to transmit the speed-reduced rotation to the cam shaft 2.

As shown in FIG. 1, the electric motor 8 is a DC motor with a brush. The electric motor 8 includes the motor housing 5 which is a yoke arranged to rotate as a unit with the timing sprocket 1; a motor output shaft 13 which is rotatably received within the motor housing 5; four permanent magnets 14 each of which has an arc shape, is and which is a stator fixed on an inner circumference surface of the motor housing 5 by adhesive; and the power feeding plate 11 fixed on a front end portion of the motor housing 5.

The motor output shaft 13 serves as an armature. The motor output shaft 13 is formed into a stepped cylindrical shape. The motor output shaft 13 includes a stepped portion which is formed at a substantially central portion of the motor output shaft 13 in the axial direction; a large diameter portion 13*a* which is positioned on the cam shaft 2's side of the stepped portion; and a small diameter portion 13*b* on the cover member 4's side of the stepped portion. An iron core rotor 17 is fixed on an outer circumference of the large diameter portion 13*a*. The eccentric shaft portion 39 which constitutes a part of the speed reduction mechanism 12, and which is an eccentric cam is integrally connected at the rear end edge of the large diameter portion 13*a* in the axial direction.

On the other hand, an annular member 20 is fixed on an outer circumference of the small diameter portion 13*b* by the press-fit. A commutator 21 (described later) is fixed on an outer circumference surface of the annular member 20 by the press-fit from the axial direction.

The iron core rotor 17 is made from a magnetic material having a plurality of magnetic poles. The iron core rotor 17 includes an outer circumference portion which is a bobbin that has slots on which coil wire of coil 18 is wound; and an inner circumference portion. The inner circumference portion of the iron core 17 is positioned and fixed on the outer circumference of the stepped portion of is the motor output shaft 13 in the axial direction.

On the other hand, the commutator 21 is made from conductive material into an annular shape. The commutator 21 includes segments which are obtained by dividing the commutator 21 by the number which is identical to the number of the poles of the iron core rotor 17, and to which terminals of the pulled-out coil wire of the coil 18 are electrically connected.

The permanent magnets 14 are disposed with predetermined clearances in the circumferential direction. The entire permanent magnets 14 are formed into a cylindrical shape. The permanent magnets 14 have the plurality of the magnetic poles in the circumferential direction. The permanent magnets 14 are positioned at axial positons which are offset from the axial center (the center in the axial direction) of the iron core rotor 17 on the power feeding plate 11's side.

Figure 7:
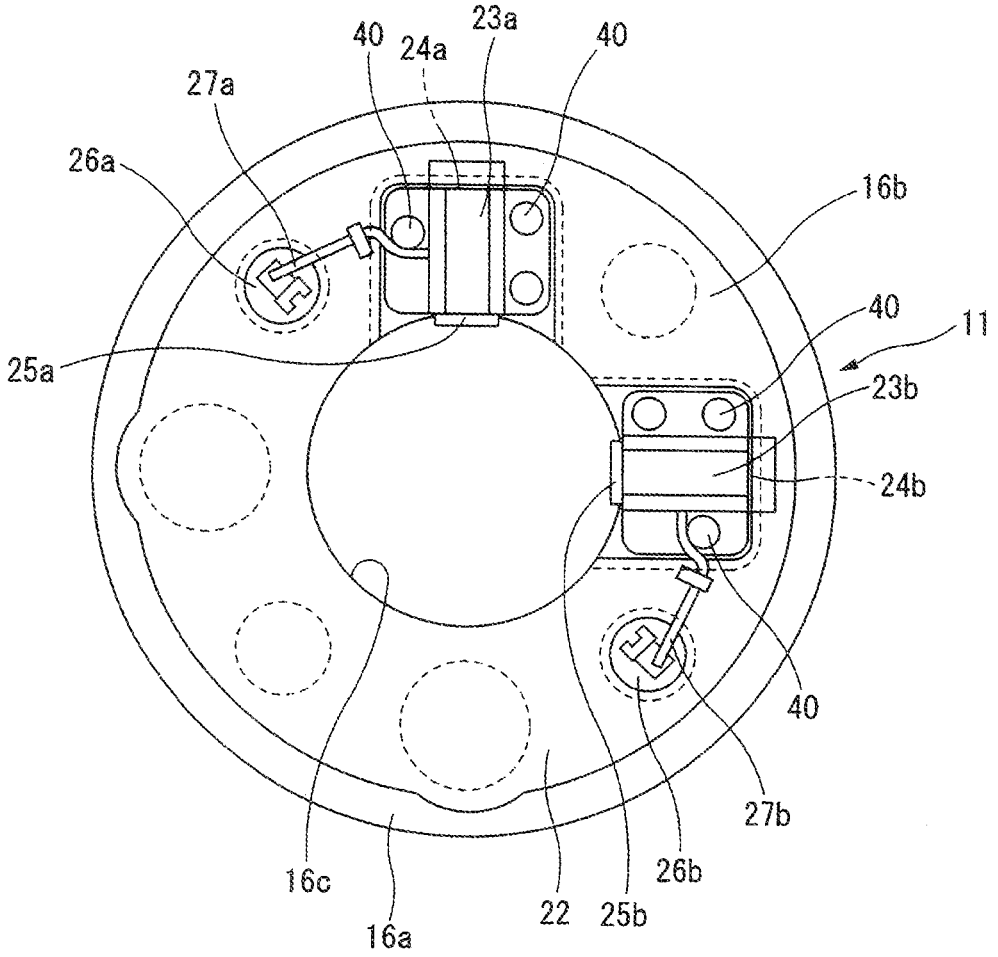
FIG. 7 is a back view showing a power feeding plate in this embodiment.

As shown in FIG. 1 and FIG. 7, the power feeding plate 11 includes a metal plate portion 16*a* which is made from metal series material, and which has a disc shape; and a resin portion 16*b* which has a circular plate shape, and which is molded on front and rear side surfaces of the metal plate portion 16*a*. Besides, this power feeding plate 11 constitutes a part of the power feeding mechanism to the electric motor 8.

The metal plate 16*a* includes an outer circumference portion which is not covered with the resin portion 16*b*, and which is poisoned and fixed in an annular stepped recessed portion that is formed on the inner is circumference of the front end portion of the motor housing 5 by caulking. Moreover, the metal plate 16 includes a shaft insertion hole 16*c* which is formed at a central portion of the metal plate 16, which penetrates through the metal plate 16*a*, and through which the small diameter portion 13*b* of the motor output shaft 13 and so on is inserted. Furthermore, the metal plate 16*a* includes two holding holes which have rectangular shapes, which are formed, by punching (stamping), on an inner circumference edge of the shaft insertion hole 16*c* at predetermined continuous positions.

Moreover, the power feeding plate 11 is provided with a pair of the brush holders 23*a* and 23*b* which are made from a copper, which are formed into cylindrical shapes, which are disposed, respectively, within the holding holes of the metal plate 16*a*, and which are fixed to the front end portion of the resin portion 16*b* by a plurality of rivets 40; a pair of switching brushes 25*a* and 25*b* which are received within the brush holders 23*a* and 23*b*, which are arranged to be slid in the radial directions, each of which includes an arc tip end surface that is elastically abutted on the outer circumference surface of the commutator 21 from the radial direction by spring forces of coil springs 24*a* and 24*b*, and which are commutators; inner and outer power feeding slip rings 26*a* and 26*b* which are molded and fixed on the front end portion side of the resin portion 16*b* in a state where outer side surfaces of the inner and outer power feeding slip rings 26*a* and 26*b* are exposed; and harnesses 27*a* and 27*b* which are conductors, and which electrically connect the switching is brushes 25*a* and 25*b* and the slip rings 26*a* and 26*b*.

The slip ring 26*a* which has the small diameter, and which is positioned on the inner circumference side is formed into an annular shape by punching (stamping) a thin plate made from the copper by press. The slip ring 26*b* which has the large diameter, and which is positioned on the outer circumference side is formed into an annular shape by punching (stamping) a thin plate made from the copper by press.

As shown in FIG. 1 and FIG. 3, the cover member 4 is formed into a substantially disc shape. The cover member 4 is disposed on the front end side of the power feeding plate 11 to confront the front end portion of the housing main body 5*a*. The cover member 4 includes a cover main body 28 which has a circular plate shape; and a cover portion 29 which is made from synthetic resin, and which covers the front end portion of the cover main body 28.

The cover main body 28 is made mainly from synthetic resin material. The cover main body 28 has a predetermined thickness. The cover main body 28 has an outside diameter which is larger than the outside diameter of the housing main body 5*a*. A reinforce plate 28*a* made from the metal is mold and fixed inside the cover main body 28.

As shown in FIG. 3, the cover main body 28 includes four arc boss portions 28*b* which are provided on the outer circumference portion of the cover main body 28 to protrude; and bolt insertion holes 28*c* which are formed in the boss portions 28*b*, and into which bolts fixed to a chain cover described later are inserted. The bolt insertion holes 28*c* are formed by sleeves (not shown) which are made from metal.

The cover portion 29 is formed into a disc plate shape. The cover portion 29 includes a retaining raised portion 29*a* which has an annular shape, and which is integrally formed on the outer circumference edge of the cover portion 29. The retaining raised portion 29*a* of the cover portion 29 is retained and fixed to a stepped retaining groove formed on the outer circumference portion of the cover main body 28, by the press-fit from the axial direction.

A pair of brush holders 30*a* and 30*b* are fixed to the cover main body 28 along the axial direction at positons at which the brush holders 30*a* and 30*b* confront the slip rings 26*a* and 26*b* from the axial direction. Each of the brush holders 30*a* and 30*b* has a rectangular hollow shape. Each of the brush holders 30*a* and 30*b* is made from copper. A pair of the power feeding brushes 31*a* and 31*b* are held within the brush holders 30*a* and 30*b* to be slid in the axial direction. The power feeding brushes 31*a* and 31*b* include tip end surfaces which are slidably abutted on the slip rings 26*a* and 26*b*.

A pair of twist coil springs 32 and 32 are received within the receiving grooves formed on the outer end surface of the cover main body 28. The twist coil springs 32 and 32 are urging members arranged to urge the power feeding brushes 31*a* and 31*b* toward the slip rings 26*a* and 26*b*. The twist coil springs 32 and 32 include, respectively, one end portions which are inwardly bent into a U-shape, and which are inserted and retained in the retaining grooves; and the other end portions which protrude in the radial direction, and which are elastically abutted on the rear end surfaces of the power feeding brushes 31*a* and 31*b*, and thereby to push the power feeding brushes 31*a* and 31*b* toward the slip rings 26*a* and 26*b*.

As shown in FIG. 3, a power feeding connector 33 is integrally provided at a lower end portion of the cover main body 28. The power feeding connector 33 is arranged to supply current from a power supply battery through a control unit (not shown) to the power feeding brushes 31*a* and 31*b*. The signal connector 34 is provided at the lower end portion of the cover main body 28 to protrude in parallel to the power feeding connector 33 along the radial direction. The signal connector 34 is arranged to output the rotation angle signal to the control unit.

The angle sensor 35 is provided between the small diameter portion 13*b* of the motor output shaft 13, and a central portion of the cover main body 28 to sandwich the bottom wall of the recessed groove. The angle sensor 35 is arranged to sense a rotation angle position of the motor output shaft 13.

This angle sensor 35 is an electromagnetic induction type. As shown in FIG. 1, the angle sensor 35 includes the sensed portion 50 which is fixed within the small diameter portion 13*b* of the motor output shaft 13; and the sensing portion 51 which is fixed at a substantially central position of the cover main body 28, and which is is arranged to receive a detection signal from the sensed portion 50.

The motor output shaft 13 and the eccentric shaft portion 39 are rotatably supported by the small diameter ball bearing 37 and the needle bearing 38. The small diameter ball bearing 37 is provided on the outer circumference surface of the shaft portion 10*b* of the cam bolt 10. The needle bearing 38 is disposed on the outer circumference surface of the cylindrical portion 9*b* of the driven member 9, and disposed on the axial side portion of the small diameter ball bearing 37.

The needle bearing 38 includes a cylindrical bearing retainer 38*a* which is press-fit in the inner circumference surface of the eccentric shaft portion 39; and needle rollers 38*b* which are a plurality of rolling members that are rotatably held within the bearing retainer 38*a*. These needle rollers 38*b* are rolled on the outer circumference surface of the cylindrical portion 9*b* of the driven member 9.

The small diameter ball bearing 37 includes an inner wheel which is sandwiched and fixed between the front end edge of the cylindrical portion 9*b* of the driven member 9 and the head portion 10*a* of the cam bolt 10; and an outer wheel which is fixed in the inner circumference surface of the eccentric shaft portion 39 that has the diameter-increased stepped shape by the press-fit, and which is abutted on the stepped edge formed on the inner circumference surface to be positioned in the axial direction.

A small diameter oil seal 46 is provided between is the outer circumference surface of the motor output shaft 13 (the eccentric shaft portion 39) and the inner circumference surface of the extension portion 5*d* of the motor housing 5. The small diameter oil seal 46 is arranged to prevent the leakage of the lubricant from the inside of the speed reduction mechanism 12 to the inside of the electric motor 8. This oil seal 46 separates the electric motor 8 and the speed reduction mechanism 12 by the sealing function.

The control unit is arranged to sense a current driving state of the engine based on information signals from various sensors such as a crank angle sensor (not shown), an air flow meter (not shown), a water temperature sensor (not shown), and an accelerator opening degree sensor (not shown), and to perform the engine control based on these information signals. Moreover, the control unit is configured to perform rotation control of the motor output shaft 13 by energizing the coil 18 through the power feeding brushes 31*a* and 31*b*, the slip rings 26*a* and 26*b*, the switching brushes 25*a* and 25*b*, the commutator 21 and so on, and to control a relative rotational phase of the cam shaft 2 with respect to the timing sprocket 1 by the speed reduction mechanism 12.

As shown in FIG. 1 to FIG. 4, the speed reduction mechanism 12 includes the eccentric shaft portion 39 arranged to perform the eccentric rotation movement (to rotate in an eccentric state); a middle diameter ball bearing 47 which is provided on the outer circumference surface of the eccentric shaft portion 39; the rollers 48 which are provided on the outer circumference of is the middle diameter ball bearing 47; the holding device 41 which is arranged to allow the movement of the rollers 48 in the radial direction while holding the rollers 48 in the rolling direction; and the driven member 9 which is integral with the holding device 41.

As shown in FIG. 1, the eccentric shaft portion 39 is formed into the cylindrical shape. The eccentric shaft portion 39 includes a cam surface 39*a* formed on the outer circumference surface of the eccentric shaft portion 39. The cam surface 39*a* of the eccentric shaft portion 39 has a rotation axis Y which is slightly eccentric from a rotation axis X of the motor output shaft 13 in the radial direction.

The entire of the middle diameter ball bearing 47 is disposed to be substantially overlapped with the needle bearing 38 in the radial direction. The middle diameter ball bearing 47 includes an inner wheel 47*a*; an outer wheel 47*b*; and balls 47*c* disposed between the inner and outer wheels 47*a* and 47*b*. The inner wheel 47*a* is fixed on the outer circumference surface of the eccentric shaft portion 39 by the press-fit. The outer wheel 47*b* is not fixed in the axial direction so as to be a free state. That is, this outer wheel 47*b* includes one axial end surface which is on the electric motor 8's side, and which is not abutted on any portions; and the other axial end surface which is disposed with a minute first clearance C1 between the other axial end surface and the back surface of the holding device 41 (the transmitting base portion 41*a*) which confronts the other axial end surface. With this, the outer wheel 47*b* is in the free state.

Moreover, the outer circumference surfaces of is the rollers 48 are abutted on the outer circumference surface of the outer wheel 47*b* to be rolled on the outer circumference surface of the outer wheel 47*b*, as shown in FIG. 2. An annular second clearance C2 is formed between the outer circumference surface of the outer wheel 47*b* and the inner surface of the roller holding surface 41*b* of the holding device 47. The entire of the middle diameter ball bearing 47 is arranged to be moved in the radial direction by this second clearance C2 in accordance with the eccentric rotation of the eccentric shaft portion 39, that is, to perform the eccentric movement.

The rollers 48 are made from the iron series metal. The rollers 48 are arranged to be moved in the radial directions in accordance with the eccentric movement of the middle diameter ball bearing 47, and thereby to be inserted and mounted in the internal teeth 19*a* of the internal teeth constituting section 19. The rollers 48 are arranged to be pivoted in the radial direction while being guided in the circumferential direction by the both side edges of the roller holding holes 41*c* of the holding device 41.

The lubricant passage is arranged to circulate the lubricant to lubricate the constituting members of the speed reduction mechanism 12. As shown in FIG. 1 and FIG. 2, this lubricant passage includes an oil supply passage which is formed within the bearing 02 of the cylinder head 01, and to which the lubricant is supplied from a main oil gallery (not shown); an oil supply hole 56 which is formed in the cam shaft 2 in the axial direction and in the radial direction, and which is connected to the is oil supply passage through a groove 56*a*; oil passage holes 57*a* and 57*b* which are continuously formed in the adapter 63 and the fixing end portion 9*a* of the driven member 9 from the axial direction to penetrate, and which include one end opened to the oil supply hole 56 through a circular groove 56*b*, and the other end opened to a portion near the needle bearing 38 and the middle diameter ball bearing 47; and an annular discharge hole 58 which is formed between the inner circumference surface of the stopper plate 61 and the outer circumference surface of the adapter 63, and which is arranged to discharge the lubricant that has lubricated the bearings 37, 38, and 47, the roller holding holes 41*c* (the rollers 48), and the large diameter ball bearing 43, to the outside.

The chain cover 22 is integrally formed, for example, from aluminum alloy material. As shown in FIG. 1, the chain cover 22 is disposed and fixed in the upward and downward directions to cover the entire of the timing chain (not shown) wound around the timing sprocket 1 on the front end side of the cylinder block (not shown) and the cylinder head 01 which is the engine main body. Moreover, an oil seal 54 is mounted between the chain cover 22 and the housing main body 5*a* (described later) by the press fit. The oil seal 54 seals a portion between the inner circumference surface of the chain cover 22 and the outer circumference surface of the housing main body 5*a*.

[Operations of This Embodiment]

Hereinafter, operations of this embodiment are illustrated. Firstly, the timing sprocket 1 is rotated through the timing chain in accordance with the rotation of is the crank shaft of the engine. This rotational force is transmitted through the internal teeth constituting section 19 and the internal screw constituting section 6 to the motor housing 5. With this, the motor housing 5 is synchronously rotated. On the other hand, the rotational force of the internal teeth constituting section 19 is transmitted from the rollers 48 through the holding device 41 and the driven member 9 to the cam shaft 2. With this, the cams of the cam shaft 2 open and close the intake valves.

Then, in a predetermined driving state of the engine after the start of the engine, the current is applied to the coil 18 of the electric motor 8 from the control unit through the terminal strips 33*a* and 33*a*, the pigtail harnesses, the power feeding brushes 31*a* and 31*b*, the slip rings 26*a* and 26*b*, and so on. With this, the motor output shaft 13 is rotated. The speed of this rotational force is reduced by the speed reduction mechanism 12. This speed-reduced rotational force is transmitted to the cam shaft 2.

That is, when the eccentric shaft portion 39 is rotated to be eccentric in accordance with the rotation of the motor output shaft 13, each of the rollers 48 is got over one of the internal teeth 19*a* of the internal teeth constituting section 19 while being guided by the corresponding one of the roller holding holes 41*c* of the holding device 41 in the radial direction, at each one rotation of the motor output shaft 13. The each of the rollers 48 is rolled and moved to adjacent one of the internal teeth 19*a*. This movement of the each of the rollers 48 is repeated, so as to be rolled in the circumferential direction in the abutted state. The speed of the rotation of the motor output shaft 13 is reduced by this rolling movement of these rollers 48 in the abutted state. This speed-reduced rotational force is transmitted to the driven member 9. In this case, this speed reduction ratio can be arbitrarily set by a difference between a number of the internal teeth 19*a* and a number of the rollers 48.

With this, the cam shaft 2 is relatively rotated in the positive direction or in the reverse direction relative to the timing sprocket 1, so as to convert the relative rotational phase. The opening or closing timing of the intake valve is controlled to be converted to the advance angle side or the retard angle side.

Each of the side surfaces of the protruding portion 61*b* is arranged to be abutted on one of the corresponding confronting surfaces 63*d* and 63*e* of the stopper recessed groove 64*b*, so as to restrict a maximum position (angular position restriction) of the positive or negative relative rotation of the cam shaft 2 with respect to the timing sprocket 1.

Accordingly, the opening or closing timing of the intake valve is converted to the maximum degree on the advance angle side or the retard angle side. Consequently, it is possible to improve the fuel economy (consumption) of the engine and the output of the engine.

Moreover, in this embodiment, the outside diameter of the large diameter ball bearing 43 becomes small in accordance with the size reductions of the outside diameters of the timing sprocket 1 and the motor housing 5. With this, it is possible to decrease the size of the entire device. Accordingly, it is possible to improve the freedom of the layout within the engine room of the internal combustion engine to which this valve timing control device is mounted.

As described above, in this embodiment, the entire adapter 63 is formed and bent to have the longitudinal section which is the crank shape, without varying the thickness of the adapter 63. The raised portion 65 of the adapter 63 is mounted in the first mounting groove 9*d* of the fixing end portion 9*a* of the driven member 9 from the axial direction. Moreover, the one end portion 2*a* of the cam shaft 2 is mounted in the second mounting groove 65*b* of the adapter 63 from the axial direction. With this, it is possible to decrease an axial length of the entire device for the relationship with the cam shaft 2. Furthermore, the thickness of the adapter 63 is relatively large, and entirely constant in consideration of the rigidity. Accordingly, it is possible to suppress the decrease of the strength of the adapter 63.

Moreover, the raised portion 65 of the adapter 63 is mounted in the inner circumference surface of the first mounting groove 9*d* by the press fit. Accordingly, it is possible to restrict the free movement of the inner wheel 43*b* of the large diameter ball bearing 43 in the axially outward direction.

That is, as shown in FIG. 2, when the raised portion 65*a* is mounted in the first mounting groove 9*d* by the press fit, this press-fit pressure F is acted in the radially outward direction as shown by a void arrow. With this, the annular outer circumferential wall of the fixing end portion 9*a* is slightly deformed in the diameter increasing direction. The force by this diameter increasing deformation is acted to the axially outer side of the inner wheel 43*b* of the large diameter ball bearing 43, so as to serve as a force to move the inner wheel 43*b* toward the inner side stepped surface 62*a* (a thin arrow direction). Accordingly, it is possible to restrict the movement of the large diameter ball bearing 43 in the axially outward direction, and thereby to obtain the stable support.

Moreover, the load is applied to the large diameter ball bearing 43 through the annular outer circumference wall of the fixing end portion 9*a*. With this, the axial variation of the load acted to the inner wheel 43*b* becomes smooth relative to a case where the raised portion 65*a* is directly mounted in the inner wheel 43*b* of the large diameter ball bearing 43. With this, the load to the large diameter ball bearing 43 is decreased.

[Second Embodiment]

Figure 8:
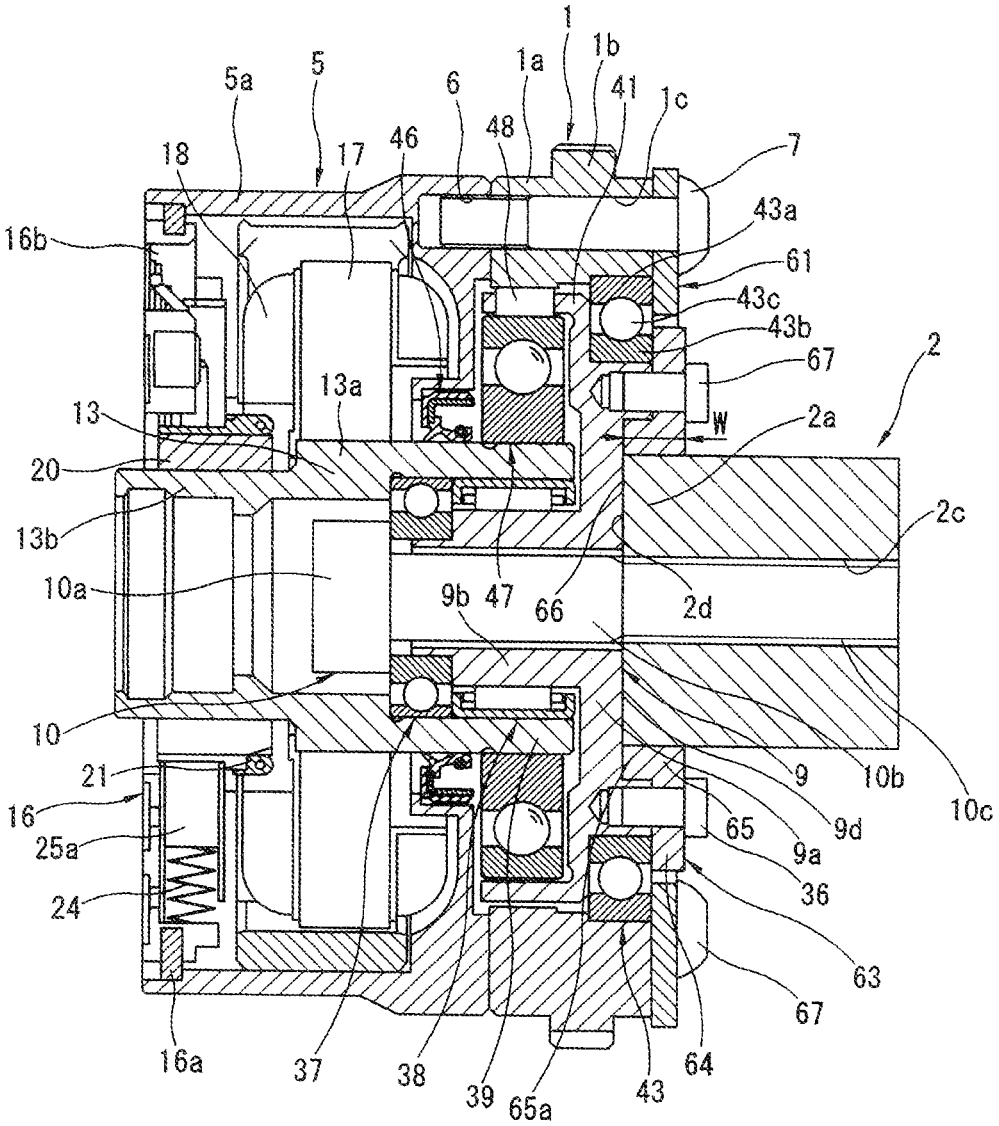
FIG. 8 is a longitudinal sectional view showing a part of a valve timing control device according to a second embodiment of the present invention.
Figure 9:
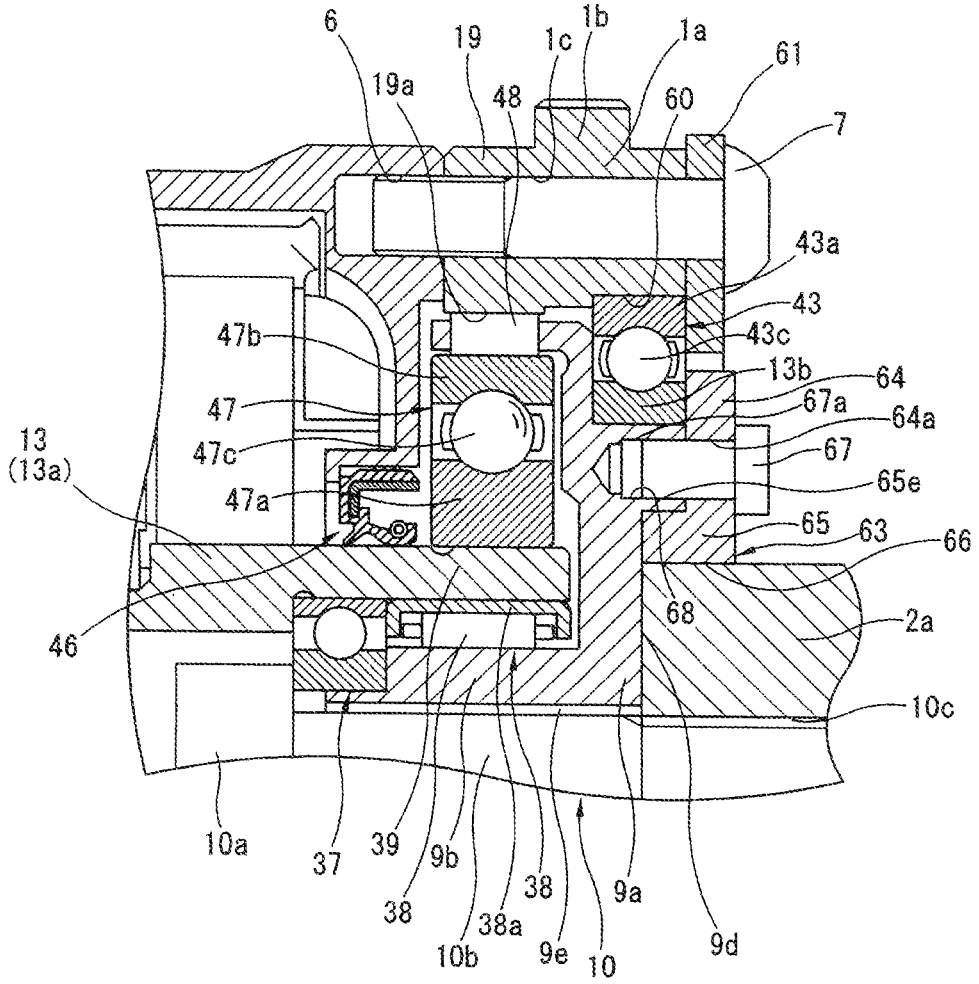
FIG. 9 is an enlarged view showing the valve timing control device shown in FIG. 8.

FIG. 8 and FIG. 9 show a second embodiment of the present invention. A basic structure of the device is identical to that of the first embodiment. However, in the second embodiment, a structure of the adapter 63 and a mounting structure of the adapter 63 are different from those of the first embodiment.

That is, the adapter 63 includes an insertion hole 66 which is formed at a central position of the inner circumference portion 65, and into which the one end portion 2*a* of the cam shaft 2 is inserted. The adapter 63 is fixed to the fixing end portion 9*a* of the driven member 9 by four bolts 67.

Specifically, the adapter 63 is formed from metal material into an annular shape. The adapter 63 includes an outer circumference portion 64 which has a flange shape; an annular inner circumference portion 65; and an insertion hole 66 formed at a central position of the inner circumference portion 65 to penetrate through the adapter 63.

The outer circumference portion 64 has a thickness and an outside diameter which are substantially identical to those of the first embodiment. The outer circumference portion 64 includes four bolt insertion holes 64*a* which are formed near the inner circumference portion 65 at a regular interval in the circumferential direction to penetrate through the outer circumference portion 64.

Moreover, the fixing end portion 9*a* includes four internal screw holes 68 which are formed on the outer side surface 9*c* on the cam shaft 2's side at a regular interval in the circumferential direction, and in which external screw portions 67*a* formed at axial tip ends of the bolts 67 are inserted.

The inner circumference portion 65 has a thickness W which is substantially twice the thickness of the outer circumference portion 64. The outer circumference surface 65*e* is mounted in the inner circumference surface of the first mounting groove 9*d* of the fixing end portion 9*a* with a minute clearance, without the press-fit.

The insertion hole 66 has an inside diameter is slightly smaller than an outside diameter of the one end portion 2*a* of the cam shaft 2. The one end portion 2*a* is inserted and mounted in the insertion hole 66. Accordingly, the one end portion 2*a* of the cam shaft 2 is merely inserted in the insertion hole 66 of the adapter 63. The one end portion 2*a* of the cam shaft 2 is not directly connected to the adapter 63. The one end portion 2*a* of the cam shaft 2 is directly connected to the fixing end portion 9*a* by bolt axial force of the cam bolt 10 in a state where the one end surface 2*d* is abutted on the fixing end portion 9*a* of the driven member 9.

Besides, the outer circumference surface of the outer circumference portion 64 of the adapter 63 includes a stopper groove in which the protruding portion of the stopper plate 61 is mounted, like the first embodiment.

Accordingly, in this embodiment, the one end portion 2*a* of the cam shaft 2 is directly connected to the driven member 9 without through the adapter 63 in a state where the one end portion 2*a* of the cam shaft 2 is inserted in the insertion hole 66. Accordingly, it is possible to further promote the reduction of the axial length of the device with respect to the cam shaft 2 by the thickness of the adapter 63, relative to the first embodiment.

Moreover, the adapter 63 merely serves as a stopper mechanism arranged to restrict maximum relative rotation positions on the advance angle side and the retard angle side with respect to the timing sprocket 1 mainly in cooperation with the stopper plate 61. Accordingly, it is possible to sufficiently decrease the thickness of the is adapter 63. Moreover, the inner circumference portion 65 includes an insertion hole 66 penetrating through the inner circumference portion 65. Consequently, it is possible to reduce the weight of the entire adapter 63, and thereby to decrease the weight of the device.

Moreover, the adapter 63 is not formed by the press forming to have the crank shaped longitudinal section, like the first embodiment. The adapter 63 merely has the insertion hole 66 formed in the inner circumference portion 65; and the bolt insertion holes formed in the outer circumference portion 64. Accordingly, that manufacturing operation is simple.

Furthermore, the thickness W of the inner circumference portion 65 may be set to a small thickness identical to that of the outer circumference portion 64. In this case, by setting the inside diameter of the first mounting groove 9*d* of the fixing end portion 9*a* to a value slightly larger than the outside diameter of the one end portion 2*a* of the cam shaft 2, the one end portion 2*a* is mounted in the first mounting groove 9*d* of the fixing end portion 9*a*.

The present invention is not limited to the structures of the above-described embodiments. For example, the stopper recessed groove 64*b* of the stopper mechanism may be formed in the stopper plate 61 side. The protruding portion 61*b* may be formed in the adapter 63 side. Moreover, the protruding portion 61*b* may be a pin.

The driving rotation member may be a timing pulley and so on, in place of the timing sprocket.

For example, below-described aspects are conceivable as the valve timing control device for the internal combustion engine based on the above-explained embodiments.

A valve timing control device for an internal combustion engine includes; a driving rotation member to which a rotational force is transmitted from a crank shaft; a driven rotation member arranged to rotate as a unit with a cam shaft; a bearing portion which is provided between the driving rotation member and the driven rotation member, and which supports the driving rotation member and the driven rotation member so that the driving rotation member and the driven rotation member are rotated relative to each other; an electric motor arranged to rotate the driven rotation member relative to the driving rotation member by drivingly rotating a motor output shaft; a fixing member disposed between an axial one end portion of the cam shaft and the driven rotation member; and a stopper mechanism disposed between the driving rotation member side and the fixing member, and arranged to restrict a maximum relative rotation position between the driving rotation member and the driven rotation member, the driven rotation member including a first recessed portion formed at a position to confront the axial one end portion of the cam shaft, and the fixing member including a second recessed portion which is formed at a position to confront the axial one end portion of the cam shaft, and in which the one end portion of the cam shaft is mounted from an axial direction, and a raised portion mounted in the first recessed portion.

In another preferable aspect, the fixing member is formed into a disc shape; the fixing member is bent so that the raised portion and the second recessed portion are formed together; and a bottom wall of the second recessed portion is sandwiched between a bottom surface of the first recessed portion and the one end portion of the cam shaft.

In another preferable aspect, a minute clearance is formed between an inner end surface of the fixing portion which is positioned radially outside the raised portion, and an outer surface of the driven rotation member which is positioned radially outside the first recessed portion, and which confronts the inner end surface from the axial direction.

In another preferable aspect, the bearing portion includes an inner wheel mounted on an outer circumference surface of the driven rotation member by press fit, and an outer wheel mounted in an inner circumference surface of the driving rotation member by the press fit; an inner circumference surface of the first recessed portion is disposed at a position to be overlapped with the inner wheel of the bearing portion in a radial direction; and the raised portion of the fixing member is mounted in the first recessed portion by the press fit.

In another preferable aspect, the stopper mechanism includes a groove portion which has a substantially arc shape, and which is provided to one of the driving rotation member side and the fixing member; and a protruding portion which is provided to the other of the driving rotation member side and the fixing member, and which is arranged to be moved within the groove portion in a circumferential direction, thereby to be abutted on one circumferential end edge of the groove portion or the other circumferential end edge of the groove portion, and to restrict a maximum relative rotation position of the driving rotation member and the driven rotation member.

In another preferable aspect, the groove portion is formed in the fixing member; the protruding portion is formed in the driving rotation member side.

In another preferable aspect, the protruding portion is provided to a stopper plate which has an annular shape, and which is fixed on an outer circumference side of the driving rotation member.

In another preferable aspect, the stopper mechanism includes a groove portion which has a substantially arc shape, and which is provided to one of the driving rotation member side and the fixing member; and a pin which is provided to the other of the driving rotation member side and the fixing member, and which is arranged to be moved within the groove portion in a circumferential direction, thereby to be abutted on one circumferential end edge of the groove portion or the other circumferential end edge of the groove portion, and to restrict a maximum relative rotation position of the driving rotation member and the driven rotation member.

In another preferable aspect, the bearing portion is a rolling bearing disposed between the driving rotation member and the driven rotation member; and the fixing member is arranged to restrict a movement of the rolling bearing on one side of an axial direction.

In another preferable aspect, the second recessed portion and the raised portion of the fixing member are simultaneously formed by press forming the fixing member.

In another preferable aspect, A valve timing control device for the internal combustion engine includes: a driving rotation member to which a rotation force is transmitted from a crank shaft; a driven rotation member arranged to rotate as a unit with a cam shaft; a speed reduction mechanism arranged to reduce a speed of a rotational force of the electric motor, to transmit the speed reduced rotation to the driven rotation member, and thereby to rotate the driven rotation member relative to the driving rotation member; a fixing member disposed between the driven rotation member and the cam shaft, and fixed to the driven rotation member; and a stopper mechanism formed between the driving rotation member side and the fixing member, and arranged to restrict a maximum relative rotation position between the driving rotation member and the driven rotation member, the fixing member including an insertion hole in which an axial one end portion of the cam shaft is inserted, and which penetrates through the fixing member, and the driven rotation member including a recessed portion on which an end surface of the one end portion of the cam shaft is abutted in a state where the one end portion of the cam shaft is inserted into the insertion hole.

In another preferable aspect, the fixing member is fixed to the driven rotation member by bolts.

In another preferable aspect, the driven rotation member is fixed to the cam shaft by a cam bolt.

The invention claimed is:

1. A valve timing control device for an internal combustion engine, the valve timing control device comprising:

a driving rotor to which a rotational force is transmitted from a crank shaft;

a driven rotor arranged to rotate as a unit with a cam shaft;

a bearing portion which is provided between the driving rotor and the driven rotor, and which supports the driving rotor and the driven rotor so that the driving rotor and the driven rotor are rotated relative to each other;

an electric motor arranged to rotate the driven rotor relative to the driving rotor by drivingly rotating a motor output shaft;

a fixing flange disposed between an axial one end portion of the cam shaft and the driven rotor; and a stopper disposed between the driving rotor and the fixing flange, and arranged to restrict a maximum relative rotation position between the driving rotor and the driven rotor, the driven rotor including a first recessed portion formed at a position to confront the axial one end portion of the cam shaft, and the fixing flange including a second recessed portion which is formed at a position to confront the axial one end portion of the cam shaft, and in which the axial one end portion of the cam shaft is mounted from an axial direction, and a raised portion mounted in the first recessed portion.

2. The valve timing control device for the internal combustion engine as claimed in claim 1, wherein the fixing flange is formed into a disc shape; the fixing flange is bent so that the raised portion and the second recessed portion are formed together; and a bottom wall of the second recessed portion is sandwiched between a bottom surface of the first recessed portion and the axial one end portion of the cam shaft.

3. The valve timing control device for the internal combustion engine as claimed in claim 2, wherein a clearance is formed between an inner end surface of the fixing flange which is positioned radially outside the raised portion, and an outer surface of the driven rotor which is positioned radially outside the first recessed portion, and which confronts the inner end surface from the axial direction.

4. The valve timing control device for the internal combustion engine as claimed in claim 2, wherein the second recessed portion and the raised portion of the fixing flange are simultaneously formed by press forming the fixing flange.

5. The valve timing control device for the internal combustion engine as claimed in claim 1, wherein the bearing portion includes an inner wheel mounted on an outer circumference surface of the driven rotor by a press fit, and an outer wheel mounted in an inner circumference surface of the driving rotor by the press fit; an inner circumference surface of the first recessed portion is disposed at a position to be overlapped with the inner wheel of the bearing portion in a radial direction; and the raised portion of the fixing flange is mounted in the first recessed portion by the press fit.

6. The valve timing control device for the internal combustion engine as claimed in claim 1, wherein the stopper includes a groove portion which has a substantially arc shape, and which is provided to one of the driving rotor and the fixing flange; and a protrusion which is provided to a remaining one of the driving rotor and the fixing flange, and which is arranged to be moved within the groove portion in a circumferential direction, thereby to be abutted on a first circumferential end edge of the groove portion or a second circumferential end edge of the groove portion, and to restrict the maximum relative rotation position of the driving rotor and the driven rotor.

7. The valve timing control device for the internal combustion engine as claimed in claim 6, wherein:

the groove portion is formed in the fixing flange; and the protrusion is formed in the driving rotor.

8. The valve timing control device for the internal combustion engine as claimed in claim 6, wherein the protrusion is provided to a stopper plate which has an annular shape, and which is fixed on an outer circumference side of the driving rotor.

9. The valve timing control device for the internal combustion engine as claimed in claim 1, wherein the stopper includes a groove portion which has a substantially arc shape, and which is provided to one of the driving rotor and the fixing flange; and a pin which is provided to a remaining one of the driving rotor and the fixing flange, and which is arranged to be moved within the groove portion in a circumferential direction, thereby to be abutted on a first circumferential end edge of the groove portion or a second circumferential end edge of the groove portion, and to restrict the maximum relative rotation position of the driving rotor and the driven rotor.

10. The valve timing control device for the internal combustion engine as claimed in claim 1, wherein:

the bearing portion comprises a roller bearing disposed between the driving rotor and the driven rotor; and the fixing flange is arranged to restrict movement of the roller bearing on one side of the roller bearing in the axial direction.

11. A valve timing control device for an internal combustion engine, the valve timing control device comprising:

a driving rotor to which a rotation force is transmitted from a crank shaft;

a driven rotor arranged to rotate as a unit with a cam shaft;

a speed reducer arranged to reduce a speed of a rotational force of an electric motor, to transmit the speed reduced rotational force to the driven rotor, and thereby to rotate the driven rotor relative to the driving rotor;

a fixing flange disposed between the driven rotor and the cam shaft, and fixed to the driven rotor; and a stopper formed between the driving rotor and the fixing flange, and arranged to restrict a maximum relative rotation position between the driving rotor and the driven rotor, the fixing flange including an insertion hole in which an axial one end portion of the cam shaft is inserted, and which penetrates through the fixing flange, and the driven rotor including a recessed portion on which an end surface of the axial one end portion of the cam shaft is abutted in a state where the axial one end portion of the cam shaft is inserted into the insertion hole.

12. The valve timing control device for the internal combustion engine as claimed in claim 11, wherein the fixing flange is fixed to the driven rotor by bolts.

13. The valve timing control device for the internal combustion engine as claimed in claim 11, wherein the driven rotor is fixed to the cam shaft by a cam bolt.

* * * * *